US007004118B2

(12) United States Patent
Ichihara

(10) Patent No.: US 7,004,118 B2
(45) Date of Patent: Feb. 28, 2006

(54) WATER PUMP FOR INTERNAL COMBUSTION ENGINE

(75) Inventor: Takayoshi Ichihara, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 137 days.

(21) Appl. No.: 10/853,753

(22) Filed: May 26, 2004

(65) Prior Publication Data

US 2004/0255877 A1 Dec. 23, 2004

(30) Foreign Application Priority Data

Jun. 18, 2003 (JP) ..... 2003-172711

(51) Int. Cl.
*F01P 5/10* (2006.01)

(52) U.S. Cl. ..... 123/41.44; 123/41.47
(58) Field of Classification Search ..... 123/41.44, 123/41.47
See application file for complete search history.

(56) References Cited

U.S. PATENT DOCUMENTS 1,433,762 A * 10/1922 Wallick ..... 415/121.3
2,877,751 A * 3/1959 Johnston ..... 123/41.12
6,161,284 A 12/2000 Glanfield et al.
2003/0029394 A1 2/2003 Miyagawa et al.

FOREIGN PATENT DOCUMENTS

| | | |
|---|---|---|
| EP | 1 211 391 A1 | 6/2002 |
| JP | 6-42348 A | 2/1994 |
| JP | 7-91249 A | 4/1995 |
| JP | 8-74596 A | 3/1996 |
| JP | 11-148349 A | 6/1999 |

* cited by examiner

*Primary Examiner*—Noah P. Kamen
(74) *Attorney, Agent, or Firm*—Foley & Lardner LLP

(57) ABSTRACT

A water pump of an engine includes a pump housing adapted to be fixed to the engine; a pump body joined to the pump housing to define a fluid chamber of the water pump between the pump body and the pump housing; and a rotational pump shaft member extending through the pump body into the fluid chamber. A fastener set for fastening the pump housing and the pump body together includes a housing-side fastener or bolt extending in a direction along the rotational pump shaft member from the pump housing's side to the pump body's side.

16 Claims, 5 Drawing Sheets

WATER PUMP FOR INTERNAL COMBUSTION ENGINE

BACKGROUND OF THE INVENTION

The present invention relates to an internal combustion engine and more specifically to a water pump for an internal combustion engine.

A Published Japanese Patent Application Publication No. H11 (1999)-148349 shows a water pump mounted on an internal combustion engine, for circulating cooling water compulsorily. A water pump of one type includes a pump housing mounted on a cylinder block, a pump body joined to the pump housing to define a fluid chamber of the water pump between the pump body and the pump housing, and a rotational pump shaft extending through the pump body into the fluid chamber, and being rotatably supported on the pump body. A vane member or impeller is mounted on the pump shaft and received in the fluid chamber. A pump pulley is mounted on a projecting end portion of the rotational pump shaft. The pump body and the pump housing are joined by plurality of fastening bolts.

SUMMARY OF THE INVENTION

In general, fastening bolts are distributed on the radial outer side of the rim of the pump pulley so as to avoid interference of each bolt and its tool region needed for a tool, with the pump pulley, bearing member rotatably supporting a rotational pump shaft, and cooling-water passage portion, etc. This arrangement having the fastening bolts and their bolt boss portions at radial outer positions outside the rim of the pump pulley tends to increase the size and weight of the pump pulley; to deteriorate the sealing since the distance between neighboring bolts and the distance between a bolt and a seal line are increased; and to increase the number of fastening bolts required to secure an adequate pressure for sealing.

It is an object of the present invention to provide a water pump structure adequate for decreasing the size and weight of the water pump and for affording the ease in mounting the water pump on the engine.

According to one aspect of the present invention, a water pump of an engine comprises: a pump housing adapted to be fixed to the engine; a pump body joined to the pump housing to define a fluid chamber of the water pump between the pump body and the pump housing; a rotational pump shaft member extending through the pump body into the fluid chamber, and being rotatably supported on the pump body; and a fastener set fastening the pump housing and the pump body together. The fastener set includes a housing-side fastener extending in a direction along the rotational pump shaft member from the pump housing to the pump body.

According to another aspect of the invention, an engine assembly comprises: a cylinder block of an engine; a pump housing fixed to the cylinder block; a pump body joined to the pump housing to define a fluid chamber of the water pump between the pump body and the pump housing; a rotational pump shaft member extending through the pump body into the fluid chamber, and being rotatably supported on the pump body; and a fastener set fastening the pump housing and the pump body together. The fastener set includes a housing-side fastener extending through the pump housing and pump body in a first direction along the rotational shaft member, and a body-side fastener extending through the pump body and pump housing in a second direction opposite to the first direction.

DETAILED DESCRIPTION OF THE INVENTION

Figure 1:
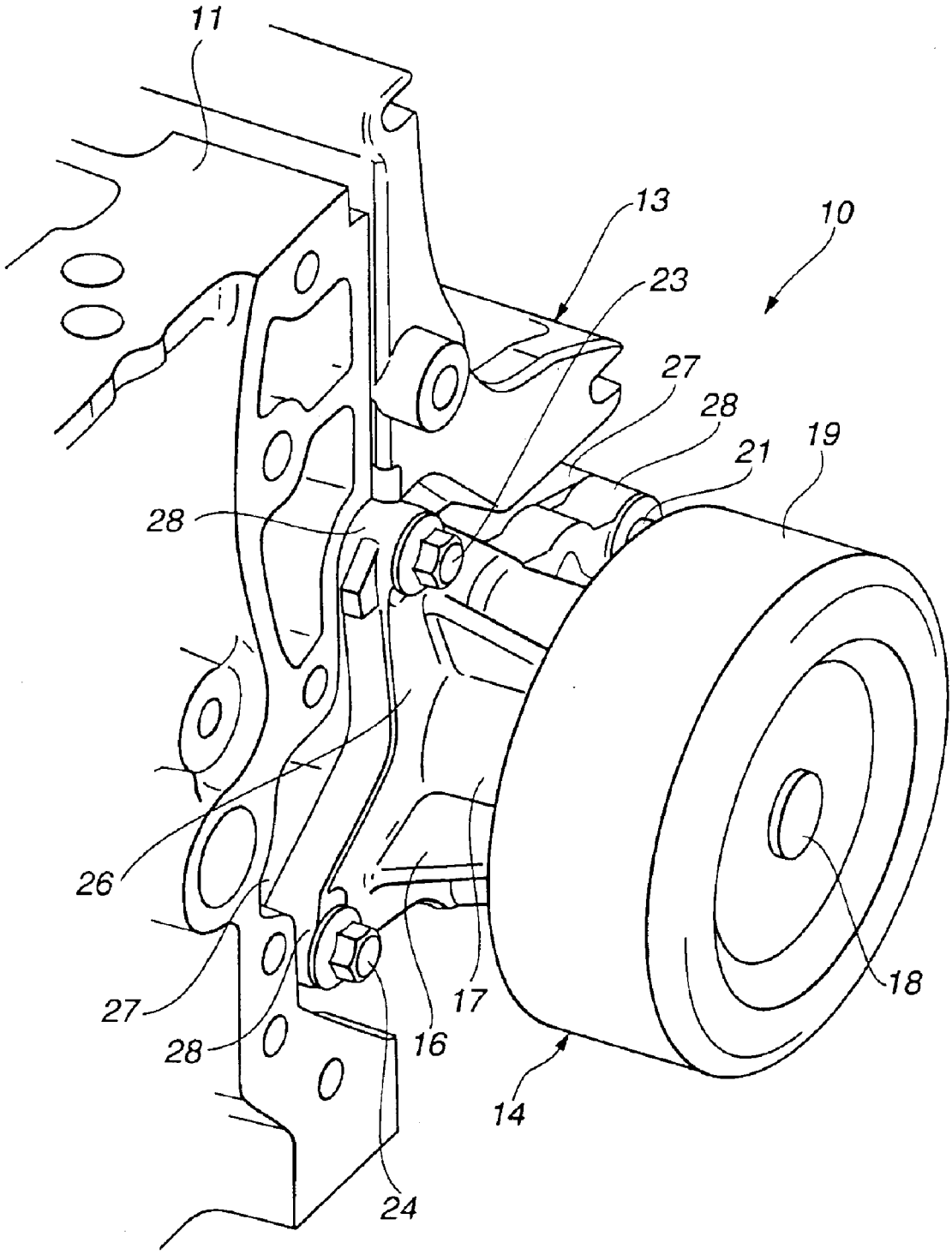
FIG. 1 is a perspective view of a water pump according to one embodiment of the present invention.
Figure 2:
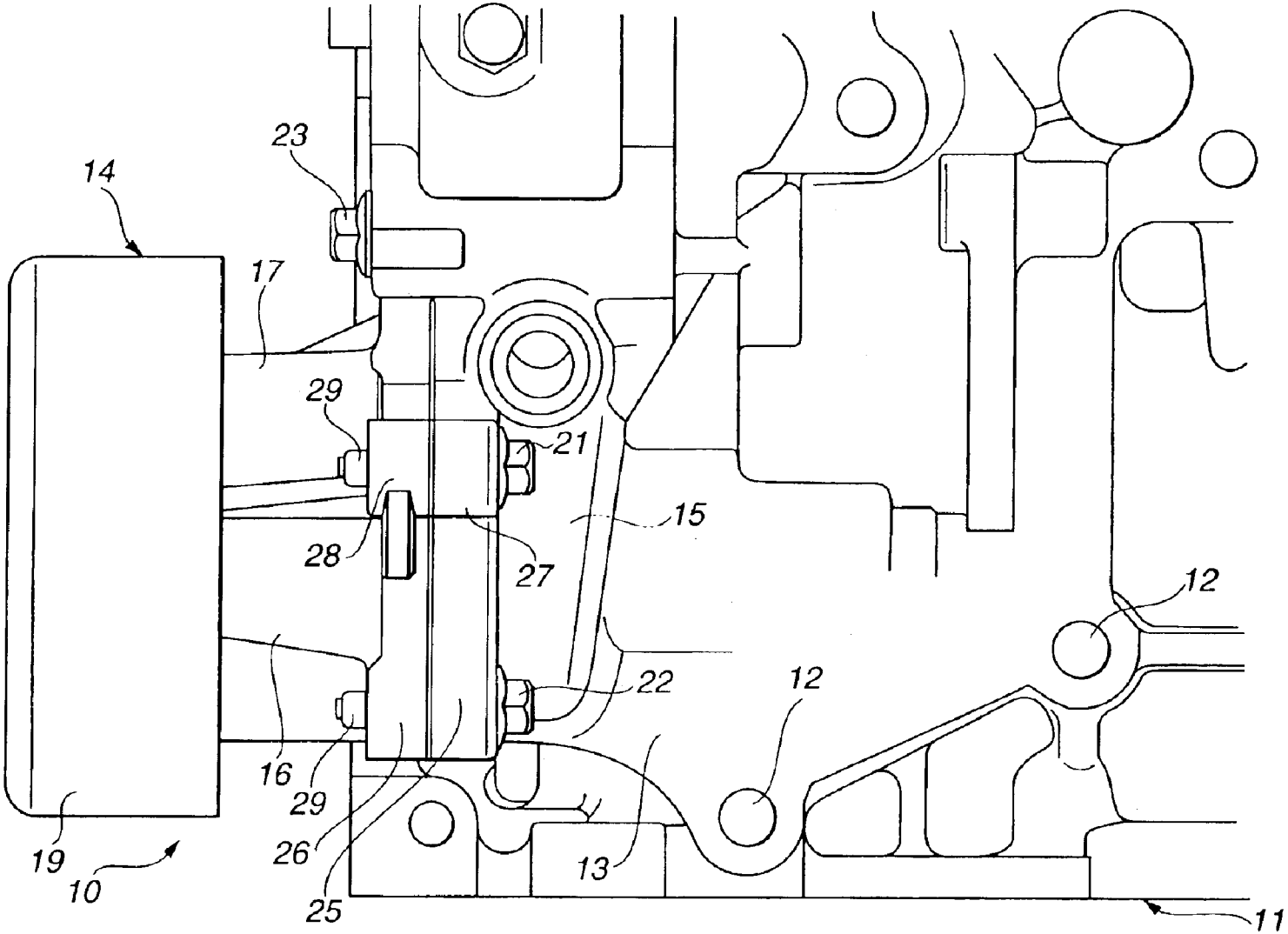
FIG. 2 is a side view showing the water pump of FIG. 1.
Figure 3:
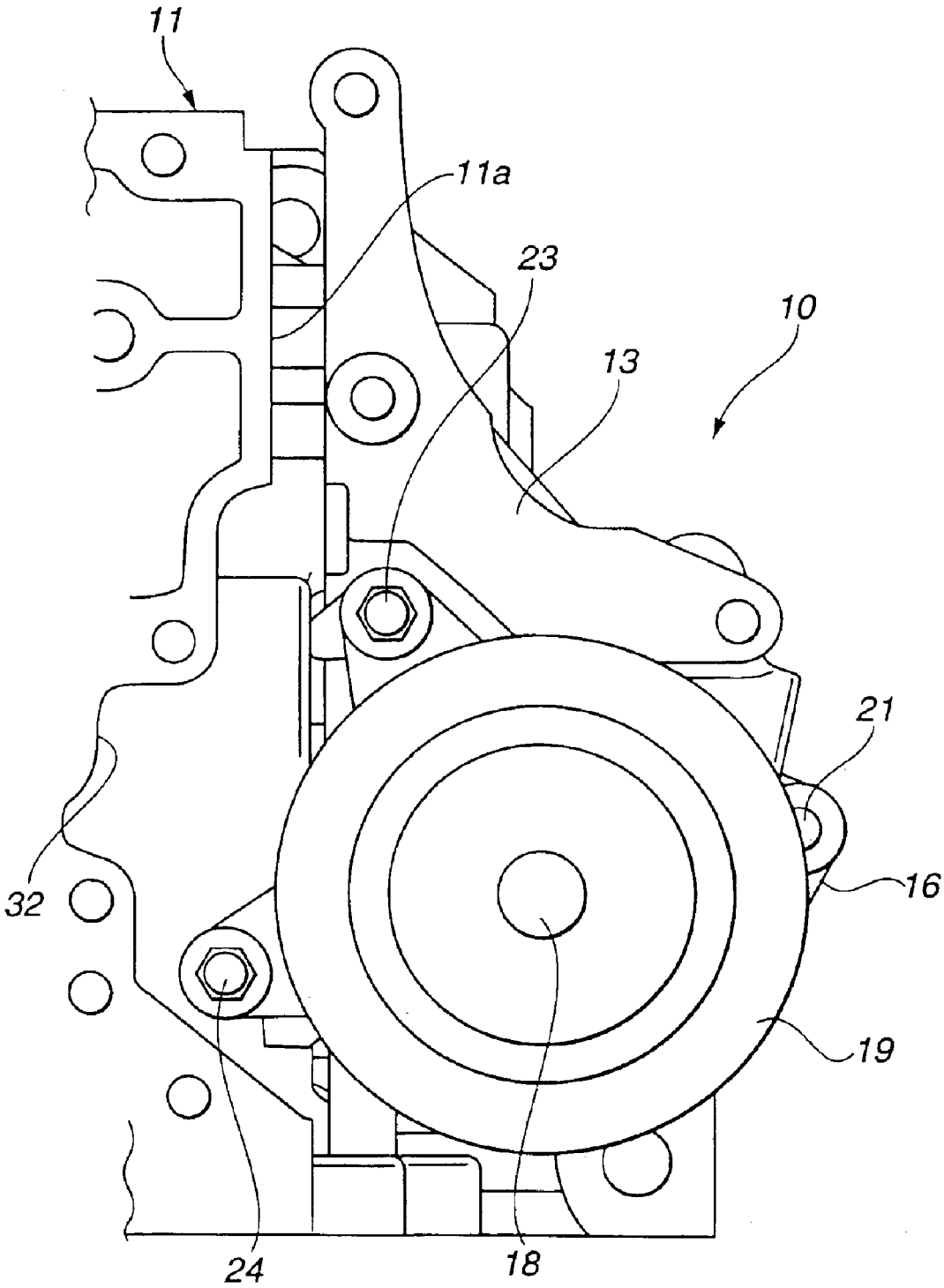
FIG. 3 is a front view showing the water pump of FIG. 1.

FIGS. 1 to 3 show a water pump 10 for an internal combustion engine according to one embodiment of the present invention. In this example, the internal combustion engine is transversely mounted in an engine compartment in a front part of a vehicle so that an intake side of the engine is located on the front side and the intake side of the engine faces to the front of the vehicle. A cylinder block 11 serves as a part of a main body of the engine, and has a first (or intake) side wall facing to the front of the vehicle, and a second side wall facing to the rear of the vehicle.

Water pump 10 has a pump housing 13 and a pump unit 14. Pump housing 13 is fixed to the first side wall of cylinder block 11, toward the front of the vehicle, near the front end of cylinder block 11. The front end of cylinder block 11 is the right or left end when the engine is transversely mounted in the vehicle. Pump unit 14 is fixed to a front side of pump housing 13, so that pump unit 14 projects forward from the front end of cylinder block 11. Pump unit 14 includes a pump body 16 which sealingly closes a scroll fluid chamber 15 formed in pump housing 13; and a rotational pump shaft 18 extending through pump body 16 into scroll fluid chamber 15. Rotational pump shaft 18 is rotatably supported by a bearing portion 17 formed in pump body 16. Pump housing 13 includes a mount side wall joined to the first side wall 11*a* of cylinder block 11 by a plurality of fastening bolts 12 as shown in FIG. 2 in the posture in which pump shaft 18 extends substantially in parallel to the first side wall of cylinder block 11.

A vane member (not shown)(or impeller) is disposed in scroll fluid chamber 15, and fixedly mounted on pump shaft 18 so that the vane member and pump shaft 18 rotate as a unit. A cylindrical pump pulley 19 is fixedly mounted on a forward end portion of rotational pump shaft 18 projecting forward from the pump body 16. Pump pulley 19 is a wheel member to receive rotation from the engine to drive water pump 10. Pump pulley 19 is located on an outer side of pump body 16, so that pump body 16 is located, in the axial direction of pump shaft 18, between pump housing 13 and pump pulley 19. Pump pulley 19 has an outer rim for carrying an accessory belt, such as a V-ribbed belt. This accessory belt connects a crankshaft pulley of the crankshaft of the engine with pump pulley 19 and one or more other accessory pulleys such as a pulley for an oil pump. Therefore, rotation is transmitted from the crankshaft to rotational pump shaft 18 by the belt drive formed by the crank pulley, the accessory belt, and pump pulley 19. The vane member rotates with pump shaft 18, and forces engine cooling water under pressure out of fluid chamber 15 toward water jackets formed in cylinder block 11. Pump shaft 18, pulley 19 and vane member form a pump shaft member rotating as a unit.

Pump housing 13 and pump body 16 are joined together by a fastener set which in this example include a plurality (four in this example) of fastening bolts 21~24. Pump housing 13 has a housing-side flange 25 surrounding the opening of fluid chamber 15. Pump body 16 has an body-side flange 26 having a shape corresponding to housing-side flange 25, and having a predetermined thickness in the axial direction of rotational pump shaft 18. Housing-side flange 25 and body-side flange 26 are joined together by the bolts 21~24. Housing-side flange 25 has cylindrical housing-side bolt boss portions 27 each formed with a bolt hole (or fastener hole) for receiving one of fastening bolts 21~24. Body-side flange 26 has cylindrical body-side bolt boss portions 28 each formed with a bolt hole (or fastener hole) for receiving one of fastening bolts 21~24. Each of bolts 21~24 extends in the axial direction of pump shaft 18*a* through the bolt hole of one housing-side bolt boss portion 27 and the bolt hole of a mating one of the body-side bolt boss portions 28.

At least one of bolts 21~24 is a housing-side bolt (or fastener) inserted from pump housing 13 in one direction, and at least one of bolts 21~24 is a body-side bolt (or fastener) inserted from pump body 16 in the opposite direction. In the illustrated example, first and second bolts 21 and 22 are housing-side bolts extending in the direction from housing 13 to body 16 whereas third and fourth bolts 23 and 24 are body-side bolts extending in the opposite direction from body 16 to housing 13.

Each of the housing-side bolt boss portions 27 for the first and second bolts 21 and 22 is clamped between the mating body-side bolt boss portion 28 and the head of the corresponding housing-side bolt 21 or 22. Each of the body-side bolt boss portions 28 for the first and second bolts 21 and 22 is clamped between the mating housing-side bolt boss portion 27 and a nut 29 tightened on a threaded end portion of a shank of the corresponding housing-side bolt 21 or 22. Therefore, the heads of housing-side bolts 21 and 22 are located on the right side of the housing-side flange 25 whereas the nuts of housing-side bolts 21 and 22 as well as pump pulley 19 are located on the left side of body-side flange 26, as viewed in FIG. 2.

Near cylinder block 11, pump housing 13 includes a thick portion which is made thicker as measured in the axial direction of pump shaft 18, to accommodate water passages for the cooling water, so that, near cylinder block, there is no sufficient space for inserting a bolt from the pump housing's side. Therefore, in the illustrated example, third and fourth bolts 23 and 24 located near the side wall of cylinder 11 are inserted from the pump body's side. That is, third and fourth bolts 23 and 24 are body-side bolts inserted from the pump body's side. Each of the body-side bolt boss portions 28 for the third and fourth bolts 23 and 24 is clamped between the mating housing-side bolt boss portion 27 and the head of the body-side bolt 23 or 24. The heads of body-side bolts 23 and 24 are located on the left side of body-side flange 26, as viewed in FIG. 2.

Each of the body-side bolts 23 and 24 is inserted through the bolt hole of the corresponding body-side bolt boss portion 28, and then screwed into an internally threaded hole formed in the corresponding housing-side bolt boss portion 27. Thus, the heads of the body-side bolts 23 and 24 are located on the left side of the body-side bolt flange 26 as viewed in FIG. 2.

In this example, in order to reduce the man-hour and simplify the assembly process in a vehicle assembly line, the pump body 16, rotational pump shaft 18, vane member, and pump pulley 19 are preliminarily assembled into a subassembly as pump unit 14. Therefore, the assembly operation to fasten pump body 16 of pump unit 14 to pump housing 13 by fastening bolts 21~24 is hampered by interference between fastening bolts 21~24 and pump pulley 19.

Figure 4:
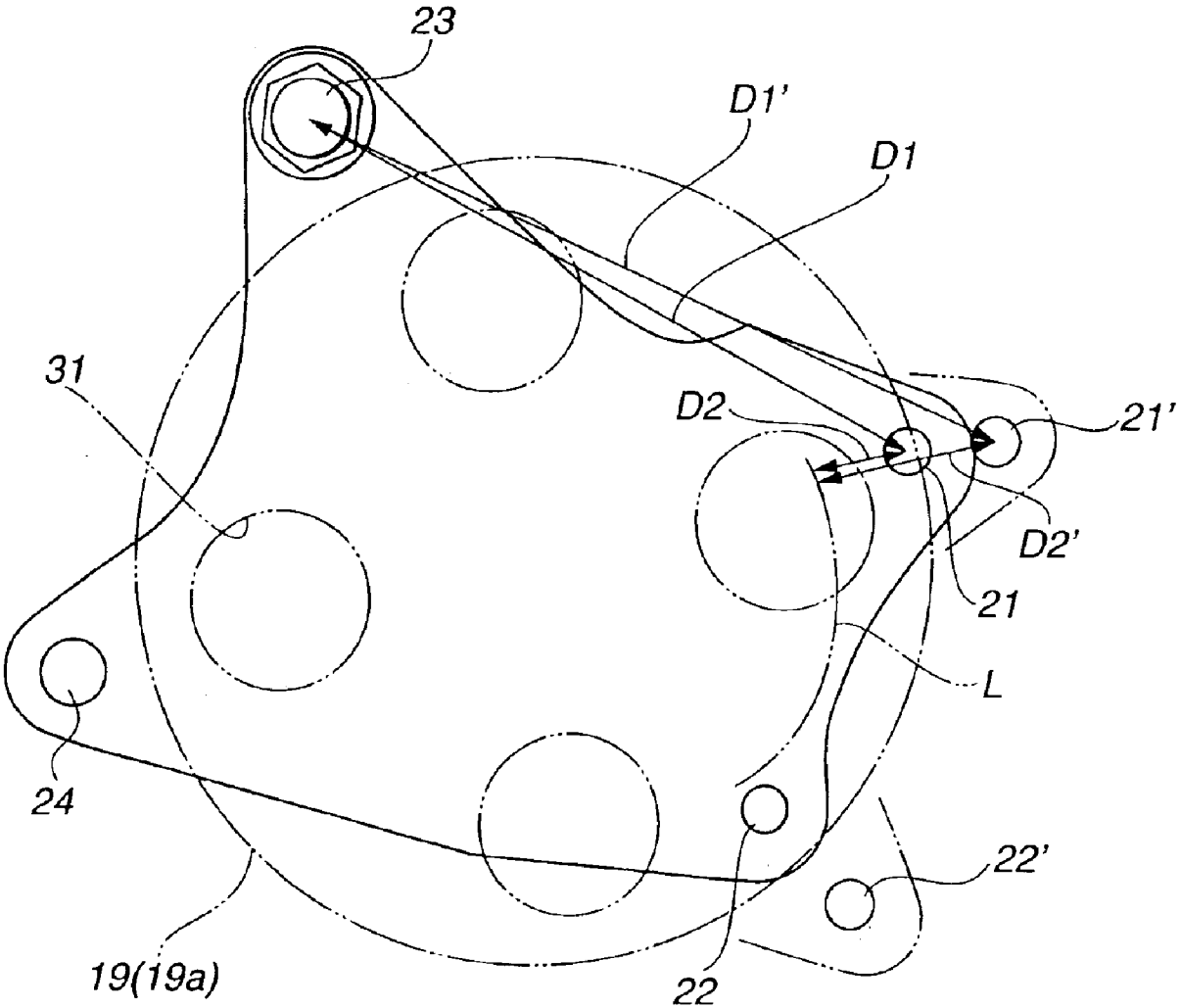
FIG. 4 is a view illustrating an arrangement of housing-side bolts of the water pump of FIG. 1.

In a comparative example shown in FIG. 4, first and second fastening bolts 21' and 22' are inserted from the body's side as well as third and fourth fastening bolts 23 and 24. In this comparative example, first and second bolts 21' and 22' are positioned radially outside the outer rim of pump pulley 19 to avoid interference of the heads of bolts 21' and 22' with bearing portion 17, pump pulley 19, or a cooling water passage formed in pump body 16. Therefore, the arrangement of the comparative example increases the inter-bolt distance D1' between two adjacent fastening bolts, and the bolt-seal-line distance D2' between the first or second bolt 21' or 22' and a seal line L. Accordingly, the arrangement of the comparative example tends to increase the sizes of the pump body and pump housing, and the number of fastening bolts required to secure the sealing.

Figure 5:
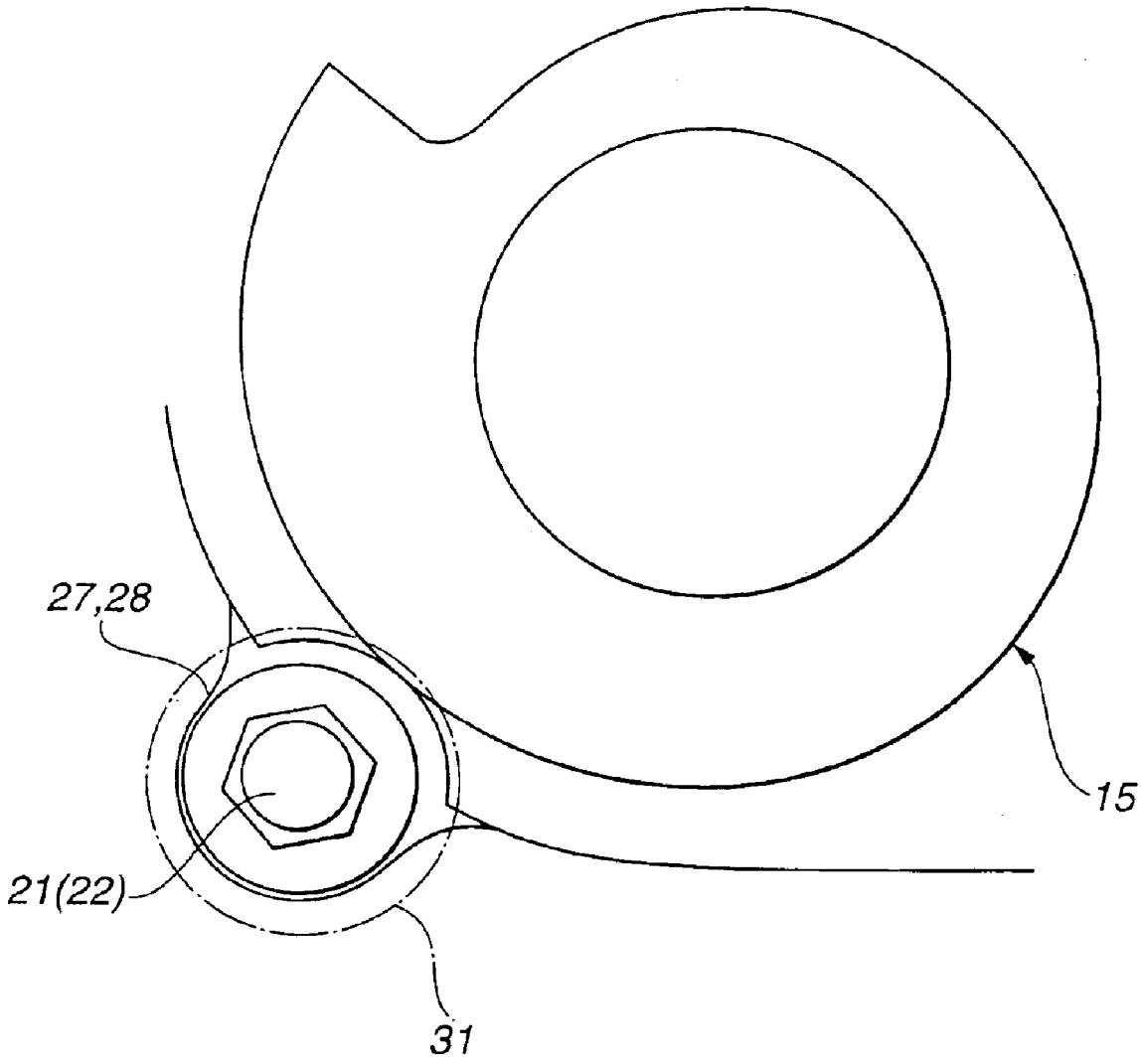
FIG. 5 is a view illustrating the position of one housing-side bolt in the water pump of FIG. 1.

In the arrangement according to the embodiment of the present invention, by contrast, the first and second fastening bolts 21 and 22 are inserted from the housing's side, and hence each of the first and second bolts can be position at a radial position closer to the axis of pump shaft 18 as compared to the comparative example or within an outer periphery 19*a* of pump pulley 19. In this example of the embodiment, the second bolt 22 is located on the radial inner side of outer periphery 19*a* of pump pulley 19, and first bolt 21 is located on outer periphery 19*a*. As shown in FIG. 5, the first and second bolts 21 and 22 according to the embodiment are located as close as possible to scroll chamber 15 within a range to ensure a required tool's region 31 of an tool for tightening bolts 21 and 22. Therefore, the arrangement according to the embodiment of the invention can reduce the inter-bolt distance D1 between two adjacent bolts and the bolt-seal-line distance D2 as compared to the comparative example shown in FIG. 4, and ensure the sealing pressure effectively without increasing the number of bolts, and without incurring the size increase the pump body. Therefore, it is possible to reduce the size and weight of the water pump, and improve the ease in installation to the engine.

It is possible to insert a bolt through a hole 31 formed in pump pulley 19 as shown in FIG. 4, from the pump pulley's side. However, when a bolt is located at such a position that the outer periphery 19*a* of pump pulley 19 intersects the range of the bolt or the required tool range 31 of the bolt (as shown in FIG. 5), the insertion of the bolt through a hole in the pulley is not feasible, and hence the limitation is severe on the layout.

As shown in FIG. 3, the bolt boss portions 27 and 28 for the fourth fastening bolt 24 project into a recess 32 depressed below the side wall 11*a* of cylinder block 11. This arrangement is effective in reducing the height of water pump 10 projecting from the mount side wall 11*a* of cylinder block 11, to the advantage of the size reduction.

Especially in the transversely mounted engine in which an accessory belt is arranged to run in the reverse state, on a part of pump pulley 19 near cylinder block 11, so as to reduce the widthwise dimension of the engine in the front and rear direction of the vehicle (in the left and right direction as viewed in FIG. 3); the water pump is an important factor exerting marked influence on the widthwise dimension of the whole engine assembly and the limitation of the layout. Therefore, it is very effective to reduce the amount of projection of water pump 10 from the side wall of the cylinder block, as mentioned above.

This application is based on a prior Japanese Patent Application No. 2003-172,711, filed in Japan on Jun. 18, 2003. The entire contents of this Japanese Patent Application No. 2003-172711 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A water pump for an engine, comprising:

a pump housing adapted to be fixed to the engine;

a pump body joined to the pump housing to define a fluid chamber of the water pump between the pump body and the pump housing;

a rotational pump shaft member extending through the pump body into the fluid chamber, and being rotatably supported on the pump body; and a fastener set fastening the pump housing and the pump body together, the fastener set including a housing-side fastener extending in a direction along the rotational pump shaft member from the pump housing to the pump body, wherein the pump housing is adapted to be fixed to a side wall of the engine, and the housing-side fastener of the fastener set extends along the side wall of the engine.

2. The water pump as claimed in claim 1, wherein the housing-side fastener includes a head clamping the pump housing between the head of the housing-side fastener and the pump body.

3. The water pump as claimed in claim 1, wherein the rotational pump shaft member is a subassembly of a pump shaft and a wheel member mounted on the pump shaft and designed to receive rotation from the engine to drive the water pump, and the pump body is located axially between the pump housing and the wheel member.

4. The water pump as claimed in claim 3, wherein the rotational pump shaft includes a forward end portion projecting forward from the pump body, beyond a front end of the cylinder block in an assembled state in which the water pump is fixed to the cylinder block of the engine; and the wheel member is a pulley mounted on the forward end portion of the rotational pump shaft, and arranged to receive rotation from the engine through a belt.

5. The water pump as claimed in claim 3, wherein the housing-side fastener is located at a radial position near an outer periphery of the wheel member so that the outer periphery of the wheel member intersects a region required to tighten the housing-side fastener with a tool.

6. The water pump as claimed in claim 1, wherein the pump housing is formed with a plurality of fastener holes to receive mounting fasteners for fixing the pump housing to the engine, the fastener holes extending in a first direction to receive the mounting fasteners extending in the first direction which is perpendicular to a second direction in which the housing-side fasteners extends.

7. A water pump for an engine, comprising:

a pump housing adapted to be fixed to the engine;

a pump body joined to the pump housing to define a fluid chamber of the water pump between the pump body and the pump housing;

a rotational pump shaft member extending through the pump body into the fluid chamber, and being rotatably supported on the pump body; and a fastener set fastening the pump housing and the pump body together, the fastener set including a housing-side fastener extending in a direction along the rotational pump shaft member from the pump housing to the pump body;

wherein the fastener set further includes a body-side fastener extending in a direction opposite to the direction of the housing-side fastener.

8. The water pump as claimed in claim 7, wherein the pump housing includes a housing-side flange; the pump body includes a body-side flange; the housing-side fastener includes a head and a shank extending from the head through fastener holes formed in the housing-side flange and the body-side flange; the housing-side flange is clamped between the head of the housing-side fastener and the body-side flange; the body-side fastener includes a head and a shank extending from the head through fastener holes formed in the body-side flange and the housing-side flange; and the body-side flange is clamped between the head of the body-side fastener and the housing-side flange.

9. The water pump as claimed in claim 8, wherein the pump housing includes a mount wall located on a first side of the rotational pump shaft member and designed to be fixed to a side wall of a cylinder block of the engine so that the rotational shaft member extends along the side wall of the cylinder block; and the body-side fastener is located on the first side of the rotational pump shaft member and the housing-side fastener is located on a second side of the rotational pump shaft member, opposite to the first side.

10. The water pump as claimed in claim 9, wherein the housing-side flange and the body-side flange include boss portions formed with the fastener holes receiving the body-side fastener, and the boss portions project outward from a plane of a wall surface of the mount wall of the pump housing.

11. The water pump as claimed in claim 8, wherein each of the housing-side flange and the body-side flange includes a plurality of bolt boss portions each of which projects radially outwards, and includes one of the fastener holes receiving one of the fasteners.

12. The water pump as claimed in claim 8, wherein the housing-side fastener includes a plurality of bolts each having a head, the housing-side flange is clamped between the body-side flange and the heads of the bolts of the housing-side fastener; the body-side fastener includes a plurality of bolts each having a head; and the body-side flange is clamped between the housing-side flange and the heads of the bolts of the body-side fastener, the bolts of the housing-side fastener and the body-side fastener being distributed around the rotational pump shaft member.

13. The water pump as claimed in claim 7, wherein a radial distance of the housing-side fastener from an axis of the rotational pump shaft member is smaller than a radial distance of the body-side fastener from the axis of the rotational pump shaft member.

14. An engine assembly comprising:

a cylinder block of an engine;

a pump housing fixed to the cylinder block;

a pump body joined to the pump housing to define a fluid chamber of the water pump between the pump body and the pump housing;

a rotational pump shaft member extending through the pump body into the fluid chamber, and being rotatably supported on the pump body; and a fastener set fastening the pump housing and the pump body together, the fastener set including a housing-side fastener extending through the pump housing and pump body in a first direction along the rotational shaft member, and a body-side fastener extending through the pump body and pump housing in a second direction opposite to the first direction.

15. The engine assembly as claimed in claim 14, wherein the engine is designed to be mounted transversely in a vehicle, the pump housing is fixed to a side wall of the cylinder block near a front end of the cylinder block, and the pump body is jointed to a front side of the pump housing.

16. The engine assembly as claimed in claim 14, wherein the cylinder block is formed with a recess depressed inward from a side wall of the cylinder block, and arranged to receive the body-side fastener.

* * * * *